United States Patent [19]

Betts et al.

[11] 4,441,338

[45] Apr. 10, 1984

[54] PRESSER FOOT DEVICE FOR A KNITTING MACHINE

[75] Inventors: Max W. Betts, Falmouth; Frank Robinson, Derby, both of England

[73] Assignee: Courtaulds PLC, London, England

[21] Appl. No.: 496,096

[22] Filed: May 19, 1983

[30] Foreign Application Priority Data

May 19, 1982 [GB] United Kingdom ..... 8214622

[51] Int. Cl.[3] ..... D04B 7/04

[52] U.S. Cl. ..... 66/64; 66/60 R

[58] Field of Search ..... 66/64, 60, 60 H, 64 H

[56] References Cited

U.S. PATENT DOCUMENTS

| | | | |
|---|---|---|---|
| 29,861 | 12/1878 | Dietschy et al. | 66/64 |
| 3,839,884 | 10/1974 | Flavell et al. | 66/64 |
| 3,973,416 | 8/1976 | Kohler | 66/64 |
| 4,027,504 | 6/1977 | Dietschy et al. | 66/64 |

FOREIGN PATENT DOCUMENTS

| | | | |
|---|---|---|---|
| 58556 | 8/1982 | United Kingdom | 66/64 |

*Primary Examiner*—Ronald Feldbaum
*Assistant Examiner*—Mary A. Ellis
*Attorney, Agent, or Firm*—Davis, Hoxie, Faithfull & Hapgood

[57] ABSTRACT

A presser foot device for a knitting machine includes a blade-like support which, when mounted in the knitting machine, extends downwardly with respect to the needles of the machine, a presser element carried by the support near its lower edge, and a channel-like protective element which enfolds the lower edges of the blade-like support to protect it. The channel-like protective element may include two laminas one at each side of the blade-like support and extending at least as low as the lower edge of the blade-like support, and at least one connecting member joining the laminas and extending between them below the lower edge of the blade-like support.

9 Claims, 8 Drawing Figures

PRESSER FOOT DEVICE FOR A KNITTING MACHINE

This invention relates to a presser foot device for a knitting machine. Such a device comprises an element extending, in its operational position, longitudinally of and between the needle beds (or adjacent the single needle bed in a single bed machine), just below the region of needle cross-over in the region of the active needles. The device enables knitting to be carried on without use of the conventional roller take-down, facilitating the knitting of stitch structures and fabric shapes which cannot be knitted using roller take-down.

The function of the presser foot is to hold down the loops of knitted fabric when the needles rise to take more yarn, and thereby allow the knitting action to proceed without any need to exert tension on the fabric from below the needle beds.

One form of presser foot device, for use in flat V-bed knitting machines, is disclosed in British Patent Specification No. 1,288,043. In that device, a support extends downwardly from a presser foot carrier. Two presser feet are mounted on the lower end of the support and project away from each other in substantially opposite directions. The support is movably mounted on the carrier so as to be movable to bring one of the two presser feet into an operative position, for movement of the carrier in one direction along the needle beds and to bring the other presser foot into an operative position for movement of the carrier in the opposite direction along the needle beds. The presser foot carrier is arranged to carry the support and the presser feet to-and-fro along the needle beds in synchronism with the activation of the needles and the presser feet are so located that the operative presser foot will hold down the loops on the needles as the needles rise.

The present invention is concerned with an advantageous construction of a support in a presser foot device and the elements attached to it which serve to hold down the knitted loops, the object being to provide a support which is light and strong, which holds the associated elements securely and which is protected from undue stresses which might be applied to it, in use, by the knitted loops. The invention may be applicable in knitting machines other than flat V-bed machines, for example, circular machines.

According to the invention, a presser foot device for a knitting machine comprises a blade-like support so arranged that, when mounted in the knitting machine, the blade-like support extends downwardly with respect to the needles and a presser element is carried on the blade-like support near the lower edge thereof, there being a channel-like protective element enfolding the lower edge of the blade-like support to protect it.

The channel-like protective element may comprise two laminas located one at each side of the blade-like supporting member and extending at least as low as the lower edge of said blade-like support, said laminas being joined together by at least one connecting member extending between them below the lower edge of said blade-like support and protecting said lower edge thereof.

Said laminas may each be constituted by a plate-like element covering a substantial proportion of a surface of said blade-like support. Said connecting member may be a single continuous connecting member extending between the laminas and forming, with the laminas, a channel-like member enfolding said lower edge of the blade-like support.

As an alternative, two spaced connecting members may extend between the laminas, one protecting each end of said lower edge of the blade-like support. In this case, the channel-like protective element has a central open portion without a base to the channel.

The blade-like support may be constituted by a reinforced synthetic resin composite material, for example a material reinforced with carbon fibre, having said presser element embedded in it, and said laminas may be riveted to said support.

End portions of the laminas, at least near the lower edge of said blade-like support, may project from the laminas in the region of said presser element and may diverge from one another on opposite sides of said presser element so that each is located, in use in a flat V-bed knitting machine, close to knock-over bits of an associated needle bed of the knitting machine.

Extensions may project from one or both ends of the protective element, each below a presser element, and each wider than the associated presser element so that, in use, each extension extends close to knock-over bits of an associated needle bed of a flat V-bed knitting machine.

The invention will be further described, by way of example, with reference to the accompanying drawings in which.

In the drawings, like reference numerals are used for similar parts throughout all the Figures.

Figure 1:
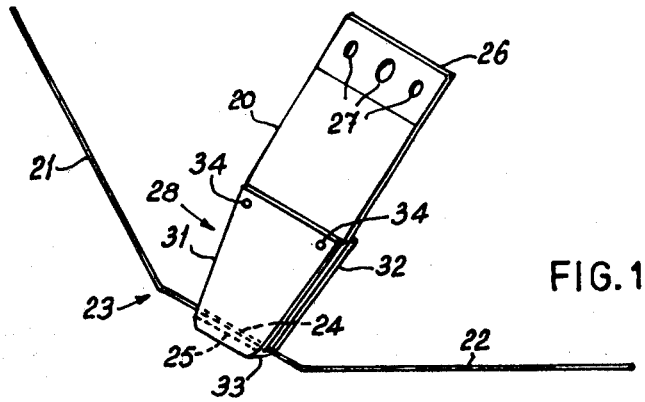
FIGS. 1 to 4, 6 and 7 are perspective views of six different embodiments of the presser foot device according to the invention.

The presser foot device shown in FIG. 1 comprises a blade-like support 20 made, in this example, of a synthetic resin composition reinforced with carbon fibre. The support 20 carries two presser elements 21 and 22 constituted by different portions of a piece 23 of steel wire the central portion 24 of which is embedded in the support 20 just within and parallel to the lower edge 25 of the support. In order to enable the presser foot device to be secured to a mounting in a flat V-bed knitting machine, in this example, a metal plate 26 is embedded in the upper part of the support 20 and has apertures 27 to receive connecting pins.

To protect the lower edge of the blade 20 against forces applied, in use, by the knitted fabric, a channel-like protective element, indicated generally by the reference numeral 28, is secured to the support 20. The protective element 28 comprises two laminas 31 and 32 located one at each side of the support 20 and extending just below its lower edge 25. The laminas 31 and 32 are joined by a connecting member 33 extending between them below the lower edge 25. The connecting member 33 is integral with the laminas 31 and 32 and the protective element 28 is thus, in this example, a one-piece channel member enfolding the lower part of the support 20. The protective element 28 is secured to the support 20 by means of rivets 34 passing through the support 20 and through each of the laminas 31 and 32.

When the presser device is mounted in a flat V-bed knitting machine, the support 20 extends downwardly with respect to the needles and the presser device presses down, in use, on knitted loops. As needles of the machine are operated in succession the presser device is moved across the needle beds relative to successive knitted loops of the fabric in the machine and the forces applied to the presser device by initial contact between successive knitted loops and the presser device are absorbed by the connecting member 33 of the protective element 28.

The side edges of the two laminas 31 and 32 are pinched together near the connecting member 33 in order to give this part of the device a narrower, edge part with a flared shape, faciliating the passage of the device past yarn carriers and reducing the risk of snarling yarn in the knitting machine.

The laminas 31 and 32 may be secured to the support 20 by means other than rivets, for example by an adhesive.

Figure 2:
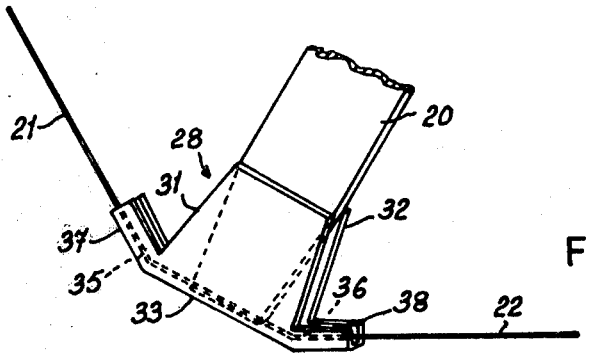

In the presser device of FIG. 2, laminas 31 and 32 are flared outwardly and downwardly so that they extend to a cranked portion 35 or 36 of each presser element 21 or 22. Channel shaped auxiliary presser elements 37 and 38 extend, one from each lower end of the channellike protective element 28, parallel in each case to an adjacent portion of a presser element 21 or 22 and, in this example, integral with the protective element 28. The auxiliary presser elements 37 and 38 are extensions of the laminas 31 and 32 and of the connecting member 33.

To enable the auxiliary presser elements 37 and 38 to contact and control parts of knitted loops at locations close to the knocking-over bits or verge pieces of a knitting machine, which is desirable when knitting fabrics formed on a single bed of needles, the auxiliary presser elements 37 and 38, together with the lower part of the protective element 28, are made substantially wider than the support 20.

The auxiliary presser elements 37 and 38 may be omitted whilst retaining the shape illustrated in FIG. 2 for the main body of the protective element 28. Alternatively, the laminas 31 and 32 may have the flared shape shown in FIG. 2 but conform closely to the support 20, as in the device of FIG. 1, the lower part of the protective element 28 being then no wider than the rest of the protective element.

Figure 3:
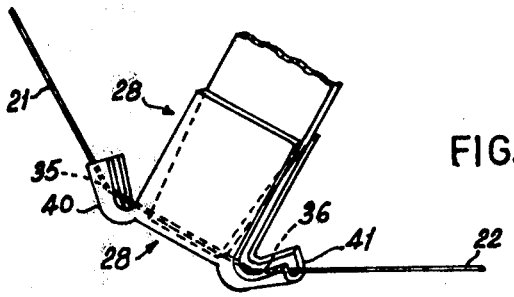

FIG. 3 shows a presser foot device with a protective element 28 the lower part of which is widened and which has flat extensions 40 and 41 each of which extends downwardly and away from the protective element and then curves upwardly towards the associated presser element 21 or 22, coming close to the presser element beyond the cranked portion 35 or 36 of the presser element.

Preferably, the extensions 40 and 41 are resilient and they may be wide enough to approach close to knocking-over bits or verge pieces in the knitting machine.

Figure 4:
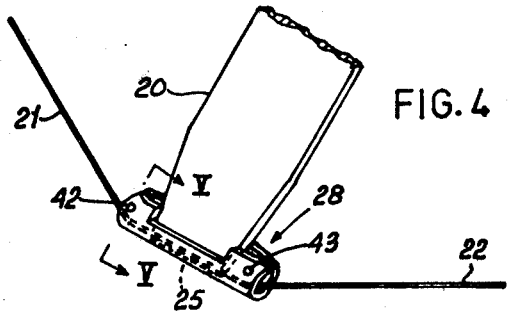
Figure 5:
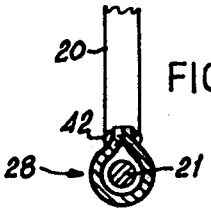
FIG. 5 is a sectional view, on an enlarged scale, taken on the line V—V of FIG. 4.

In the presser foot device of FIG. 4, a support 20 has its lower edge 25 protected by a shallow channellike protective element 28, the central upper side portions of which are cut away. The protective element 28 is secured in position by rivets 42 and 43 which pinch together the portions of the protective element 28 above presser elements 21 and 22 near each end of the lower edge 25 of the support 20, as seen in FIG. 5.

Figure 6:
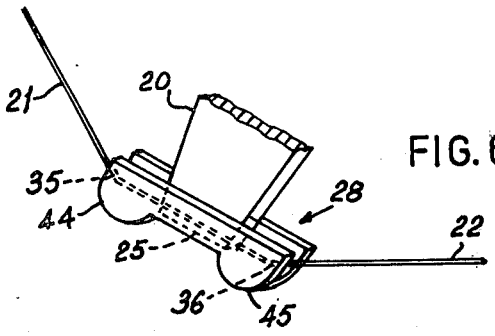

In FIG. 6, a protective element 28 for the lower edge 25 of a support 20 in a presser foot device is channel-like in shape and comprises a metal stamping showing, in cross-section, smoothly curved downward protuberances 44 and 45 extending in each case from the region of an end of the lower edge of the support 20 to beyond a crank 35 or 36 in an associated presser element 21 and 22. The protective element 28 thus protects, not only the support 20 but also the portion of each presser element 21 or 22 near the support 20.

Figure 7:
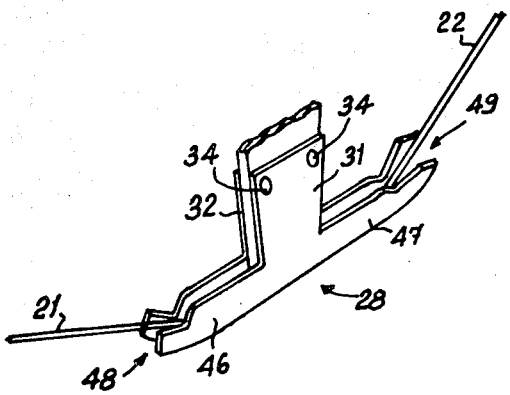

FIG. 7 shows a channel-like protective element 28 secured to a blade-like support 20 by rivets 34 extending through laminas 31 and 32.

Channel shaped auxiliary presser elements 46 and 47 extend one from each lower end of the channel-like protective element 28 parallel, initially, in each case, to an adjacent portion of a presser element 21 or 22. The extreme end portions 48 and 49 of the auxiliary presser elements 46 and 47 are bifurcated and splayed apart so that, in use, each part of the bifurcated end portions 48 and 49 will be located close to knocking-over bits or verge pieces in a knitting machine for controlling knitted loops.

Figure 8:
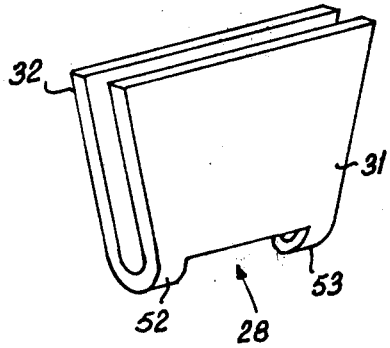
FIG. 8 is a perspective view of a protective element for use in a further presser foot device according to the invention.

FIG. 8 shows a channel-like protective element 28 for protecting a blade-like support in a presser foot device like the supports 20 shown in the previous Figures. The central lower portion of the channel-like protective element 28 of FIG. 8 is cut away leaving this central portion without a base. Thus, in this embodiment of the invention, two spaced connecting members 52 and 53 extend between laminas 31 and 32 each protecting, in use, one end of the lower edge of a blade-like support of a presser foot device.

What is claimed is:

1. A presser foot device for a knitting machine comprising:

(a) a blade-like support which, when mounted in the knitting machine, extends downwardly with respect to the needles of the machine, (b) a presser element carried by said support near its lower edge, (c) and a channel-like protective element which enfolds the lower edges of the blade-like support to protect it.

2. A presser foot device according to claim 1, wherein said channel-like protective element comprises:-

(a) two laminas located one at each side of the blade-like support and extending at least as low as the lower edge of the blade-like support, and (b) at least one connecting member joining said laminas and extending between them below the lower edge of the blade-like support.

3. A presser foot device according to claim 2, wherein each of said laminas is constituted by a plate-like element covering a substantial proportion of a respective surface of said blade-like support.

4. A presser foot device according to claim 2, wherein said connecting member is a single continuous member extending between the laminas and forming, with the laminas, a channel enfolding said lower edge of the blade-like support.

5. A presser foot device according to claim 2 adapted to support two presser elements extending in opposite directions from said blade-like support and wherein two spaced connecting members extend between said laminas, one protecting each end of said lower edge of the blade-like support.

6. A presser foot device according to claim 2, wherein said blade-like support is constituted by a reinforced synthetic resin composite material having part of at least one presser element embedded in it.

7. A presser foot device according to claim 2, wherein end portions of the laminas near the lower edge of said blade-like support project from the laminas in the region of said presser element or elements.

8. A presser foot device according to claim 7, wherein said end portions diverge from one another on opposite sides of the presser element so that each is located, in use in a flat V-bed knitting machine, close to knock-over bits of an associated needle bed of the knitting machine.

9. A presser foot device according to claim 1, wherein an extension projects from at least one end of said protective element, below the presser element, said extension being wider than the associated presser element so that, in use in a flat V-bed knitting machine, the extension extends close to knock-over bits of the knitting machine.

* * * * *